United States Patent [19]

Piesik

[11] Patent Number: 4,683,798

[45] Date of Patent: Aug. 4, 1987

[54] GAS MANAGEMENT TRANSITION DEVICE

[75] Inventor: Edward T. Piesik, Pomona, Calif.

[73] Assignee: General Dynamics, Pomona Division, Pomona, Calif.

[21] Appl. No.: 813,820

[22] Filed: Dec. 27, 1985

[51] Int. Cl.[4] ..... F41F 3/04

[52] U.S. Cl. ..... 89/1.816; 89/1.8; 89/1.812

[58] Field of Search ..... 89/1.816, 1.8, 1.812; 60/204; 138/39; 244/114 B

[56] References Cited

U.S. PATENT DOCUMENTS

| | | | |
|---|---|---|---|
| 2,056,782 | 10/1936 | Fosdick | 138/39 |
| 2,445,423 | 7/1948 | Eastman | 89/1.8 |
| 2,476,621 | 7/1949 | Okress | 285/416 X |
| 2,643,861 | 6/1953 | Losey | 285/175 X |
| 2,802,399 | 8/1957 | Little | 89/1.816 |
| 3,014,410 | 12/1961 | Anderson | 89/1.8 |
| 3,324,534 | 6/1967 | Spurk | 29/157 R |
| 3,421,781 | 1/1969 | Spurk | 138/39 |
| 3,490,236 | 1/1970 | Markowski | 60/204 |
| 3,552,780 | 1/1971 | Warren | 285/176 |
| 3,623,511 | 11/1971 | Levin | 138/39 |
| 4,044,648 | 8/1977 | Piesik | 89/1.816 X |
| 4,134,327 | 1/1979 | Piesik | 89/1.816 X |
| 4,173,919 | 11/1979 | Piesik | 89/1.8 |
| 4,186,647 | 2/1980 | Piesik | 89/1.816 X |
| 4,310,028 | 1/1982 | Kennedy | 60/204 |
| 4,324,167 | 4/1982 | Piesik | 89/1.812 X |
| 4,373,420 | 2/1983 | Piesik | 89/1.812 |
| 4,433,606 | 2/1984 | Hagelberg et al. | 89/1.812 |
| 4,470,336 | 9/1984 | Swann et al. | 89/1.816 X |

FOREIGN PATENT DOCUMENTS 720206 12/1954 United Kingdom .

*Primary Examiner*—David H. Brown

*Attorney, Agent, or Firm*—Henry M. Bissell; Edward B. Johnson

[57] ABSTRACT

A transition region for a missile launch chamber providing a smooth transition from a generally square cross-section chamber in which a missile is stored and launched to a round exit opening of the chamber which connects with an exhaust manifold or plenum. The transition section is provided with a pair of pivoted doors for closing off the bottom of the missile chamber to prevent the flow of recirculation gases from the plenum into the chamber when a missile in another chamber coupled to the same plenum system is being fired. The portion of the missile exhaust chamber between the square cross-section and the circular exit opening serves to direct the exhaust gases of a missile being fired into a smooth round exhaust plume which functions as a "gas plug", preventing the recirculation of the exhaust gases back into the chamber of the missile being fired.

10 Claims, 7 Drawing Figures

Fig. 1 - Prior Art

GAS MANAGEMENT TRANSITION DEVICE

BACKGROUND OF THE INVENTION

1. Field of the Invention.

The present invention relates to the field of controlled flow, exhaust manifold systems and, more particularly, to apparatus for controlling the flow of exhaust gases between a plurality of rocket storage and launch stations and a common exhaust gas manifold or plenum tube connected thereto.

2. Description of the prior art.

In certain military applications, particularly on warships having missile firing capability, the missiles are stored in a series of vertically oriented chambers closely adjacent one another. Exhaust gas outlets are normally provided to duct rocket exhaust gases generated during intended or accidental rocket ignitions to a safe location. In such installations, manifolding of a number of chambers into a common exhaust duct or plenum tube is often necessary.

There have been a number of approaches to the problems attendant upon the use of a common exhaust duct with a number of missile storage chambers. It is important to be able to block the exhaust gases from a missile which is being fired from blowing out the individual chambers of other missiles. This is commonly accomplished by the use of doors or hinged panels which can open from the force of an impinging missile exhaust for the chamber in which the missile being fired is located and close off the passage at the base of a missile chamber opening into the exhaust plenum for other missiles.

Whereas individual storage and launch chambers for missiles are generally round in cross-section, it will be understood that in the utilization herein in which the chambers are mounted side by side and closely adjacent one another, the chambers are constructed with a generally square cross-section for convenience and to minimize the space required to accommodate such an installation on board ship, for example. Where the rectangular cross-section is extended below the missile chamber and into the plenum, there is a likelihood that the plenum gases will flow back into the missile chamber through the residual cross-sectional area formed between the naturally circular exhaust flow from the rocket nozzle and the corners of the rectangular cross-section of the transition section. Such recirculation of plenum gas flow into the missile chamber is undesirable from the standpoint of both heat transfer as well as contaminaton.

The Spurk U.S. Pat. Nos. 3,324,534 and 3,421,781 are directed to the fabrication of a transition section between a round pipe and a pipe of the same cross-sectional area but of different shape. The transition section is also designed to provide the same cross-sectional area as the passages to which it is connected. This apparatus is principally intended for use in test chambers, such as shock tubes, supersonic flow passages, expansion tubes and the like. In contradistinction thereto, the present invention relates to a transitional section from a rocket or missile container of rectangular cross-section to a circular cross-section opening into a common plenum which channels the exhaust gases to a safe location. The circular opening is normally smaller in cross-sectional area than the rectangular opening.

British Pat. No. 720,206 describes a transition section for sheet metal duct work which changes from round to square and back to round in order to increase the cross-sectional area in the transition section, thereby permitting sharper bends to be achieved with less flow resistance. The Warren U.S. Pat. No. 3,552,780 similarly discloses a transition section connector between rectangular and circular conduits for use with gutter downspouts, principally for esthetic purposes. The Anderson U.S. Pat. No. 3,014,410 and the Little U.S. Pat. No. 2,802,399 disclose arrangements for deflecting and diverting exhaust gases from a missile, but do not involve the use of a common gas manifold or plenum tube connected thereto.

SUMMARY OF THE INVENTION

In brief, arrangements in accordance with the present invention provide a transition section from a rocket or missile container of rectilinear cross-section to a circular cross-section opening into a common plenum. In most cases, the circular opening into the plenum is of smaller cross-section than the rectangular missile storage chamber. It is important that gases not be recirculated back into the chamber of the missile being fired. Doors may be incorporated in the rectangular section to serve as flow control devices, such as those which are disclosed in my U.S. Pat. No. 4,044,648, for example. Such doors, however, are unable to completely limit the recirculation flow and it is desirable to utilize the effect of the rocket exhaust plume to develop a "gas plug" which can prevent exhaust gas recirculation. The doors are effective in completely blocking a chamber opening against exhaust gases from a missile firing in another chamber but may be inadequate when it comes to preventing recirculation of exhaust gases back into the chamber of the missile being fired.

A preferred embodiment of my invention provides a number of fillets in the respective corners of the rectangular passage, below the region where the doors are operational, thereby transforming the opening of the passage into a circular opening of diminishing cross-section in the direction of the opening into the plenum. This arrangement provides an internal surface to which the axisymmetric rocket exhaust plume will "attach"; that is, the exhaust gas plume will follow the containment surface. The momentum of the flow adjacent the surface in the transition section opposes and prevents plenum gases from returning or recirculating back toward the rocket or missile.

The transition section of the invention provides a near maximum flow area for the rocket exhaust when the missile is flying out of the container while at the same time allowing the formation of the "gas plug" while the rocket is firing in a restrained configuration. The length of the transition section is chosen to be long enough so that, in combination with the final circular area, surface "attachment" occurs when the rocket is fired. Those skilled in the art will understand that empirical methods and/or analytical methods can be used to determine this length. It has been found that once "attachment" occurs, the thrust level of the rocket (the mass flow through the transition section) can be greatly reduced, by a factor of at least two to three, before "detachment" of the exhaust flow from the transition section surfaces occurs.

The design of the transition section length and circular cross-sectional area may be developed by the use of empirical and/or analytical methods. Such methods may take account of the following parameters: the ballistic values of the rocket motor (including chamber pressure, flow rate, combustion temperature and throat diameter), the cross-sectional flow area of the missile storage chamber, the maximum chamber design pressure during normal launch, the cross-sectional flow area of the plenum or manifold, the pressure in the manifold which results from a maximum exhaust flow rate, the allowable height of the transition section, and a theoretical or experimental description of the rocket exhaust flow field as a function of time and axial and radial directions (the required flow elements being: pitot pressure, static pressure or local ambient pressure, static temperature, total temperature, velocity, Mach number, gas constant, and specific heat ratio).

BRIEF DESCRIPTION OF THE DRAWING

A better understanding of the present invention may be had from a consideration of the following detailed description, taken in conjunction with the accompanying drawings in which.

DESCRIPTION OF THE PREFERRED EMBODIMENTS

Figure 1:
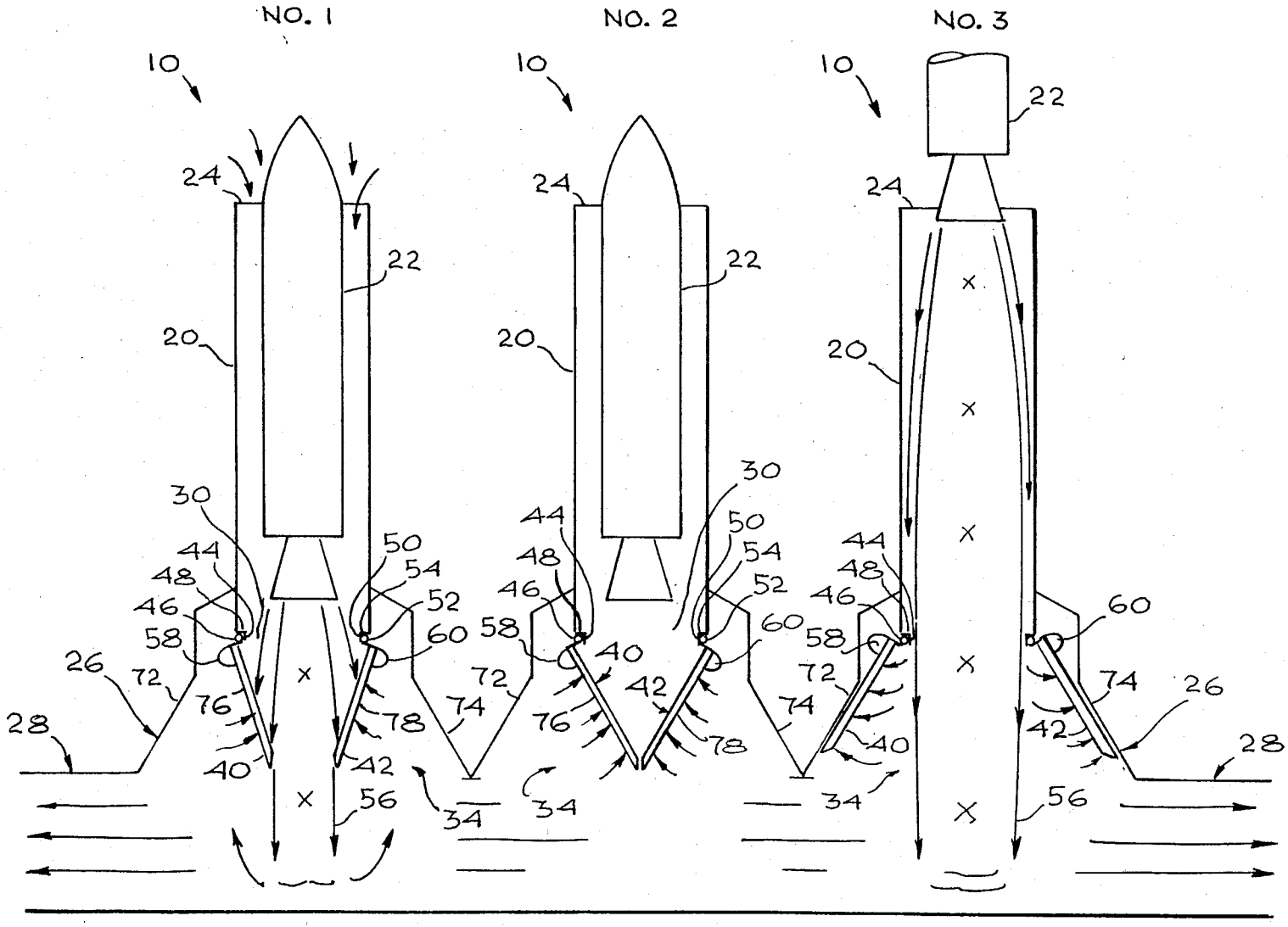
FIG. 1 is a schematic elevational diagram showing a plurality of missile storage chambers and associated plenum system of my prior U.S. Pat. No. 4.044.648.

Referring to FIG. 1, which is a schematic representation of a plurality of individual missile storage chambers coupled in the plenum system of my prior U.S. Pat. No. 4,044,648, the drawing shows a plurality of stations 10 connected to a common manifold or plenum 28. Each station 10 comprises a rocket storage chamber 20 having an upper opening 24 and a bottom opening 30 communicating with a transition section 26 that opens into the manifold 28. A missile 22 is stored in each individual chamber 20. For purposes of illustration, the missiles 22 in FIG. 1 are shown in various stages of storage and launch.

The bottom opening 30 is normally closed by a pair of angled doors or panels 40, 42 which are pivotably attached along an upper, inner edge 44 by hinge 46 to an inwardly projecting first edge portion 48 of the transition section 26. Similarly, the door 42 is pivotably attached along an opposing upper, inner edge 50 by a hinge 52 to an opposite, inwardly projecting second edge portion 54 of the transition section 26.

The doors 40 and 42, in the case of the No. 2 chamber 20 containing an unfired missile 22, pivot closed under the action of pressure in the manifold 28 when a missile in another chamber is being fired. This prevents exhaust gases from flowing from the manifold 28 upwardly through the transition section 26 and into the chamber 20. The doors 40 and 42 pivot open, under the combined action of pressure in the manifold 28 and pressure of exhaust gases emitted from the rocket 22 when it fires, by an amount to allow the exhaust stream 56 (at stations Nos. 1 and 3) flowing downwardly between the open doors to function as a gas plug preventing the flow of exhaust gases from the manifold 28 back through the doors and upwardly into the chamber 20.

The doors 40, 42 are counterbalanced by weights 58, 60, respectively, affixed to upper, outer portions of the doors. To permit the complete opening of the doors 40, 42, the transition section 26 is formed in a trapezoidal configuration, with lower portions of end walls 72, 74 of the transition section being inclined outwardly from the vertical along the axis of the manifold.

During the firing of a rocket 22, gas flow and the resultant forces are generally as indicated by the arrows. For a chamber containing an unfired missile or for one in which firing has just been initiated, the recirculating gas from a missile being launched exerts forces against the outer surfaces 76, 78 of the doors 40, 42. This maintains the doors firmly closed for an unfired missile chamber, as in No. 2, and tends to counterbalance the forces of the rocket exhaust for a missile during initial firing, as in No. 1. As a result, the doors 40, 42 of chamber No. 1 are only partially opened, thereby tending to establish the exhaust gas plug which prevents recirculation of exhaust gases up into the chamber of the missile being fired. The problem with the effectiveness of the exhaust gas plug in this particular configuration results from the generally planar shape of the two doors 40, 42 making up the bottom closure for the chamber. While these doors effectively block recirculating exhaust gases in the central portion of the chamber, they are less effective in preventing recirculation of exhaust gases in the space toward the side edges of the doors. The exhaust gas plug is flattened somewhat by the doors 40, 42 and tends to lose its effectiveness at the side fringes of the exhaust gas plume.

Figure 2:
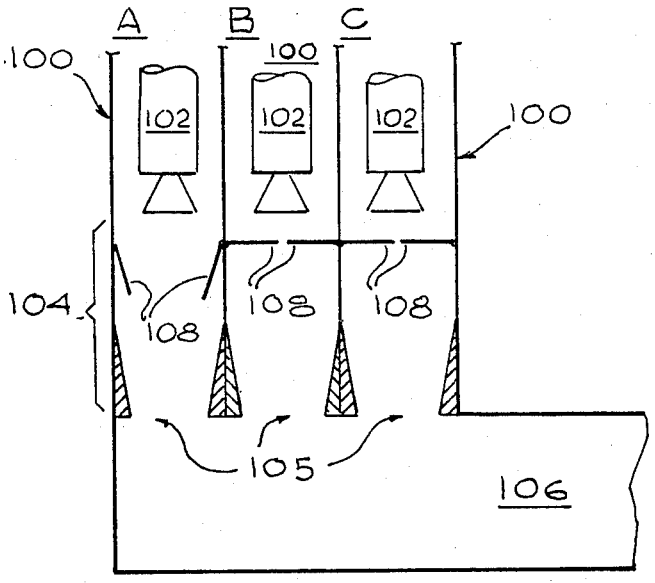
FIG. 2 is a corresponding schematic diagram of one particular arrangement in accordance with the present invention.

An improved gas management system in accordance with the present invention is schematically represented in FIGS. 2–5. FIG. 2 represents three missile chambers 100, designated A, B and C, in which for purposes of illustration a plurality of missiles 102 are shown in various stages of storage and ignition for launch. At the bottom of each chamber 100 is a transition section 104 which extends generally from the end of the exhaust nozzle of the rocket 102 in the stored position to an opening 105 which communicates with the plenum or manifold 106. A pair of doors 108 is located within each transition section 104 to control the exhaust gases from a missile 102 by permitting gases from a missile being fired (missile 102 of chamber A) to exit into the manifold 106 while blocking gases in the manifold 106 from entering chambers which are not being fired (chambers B and C).

Figure 3:
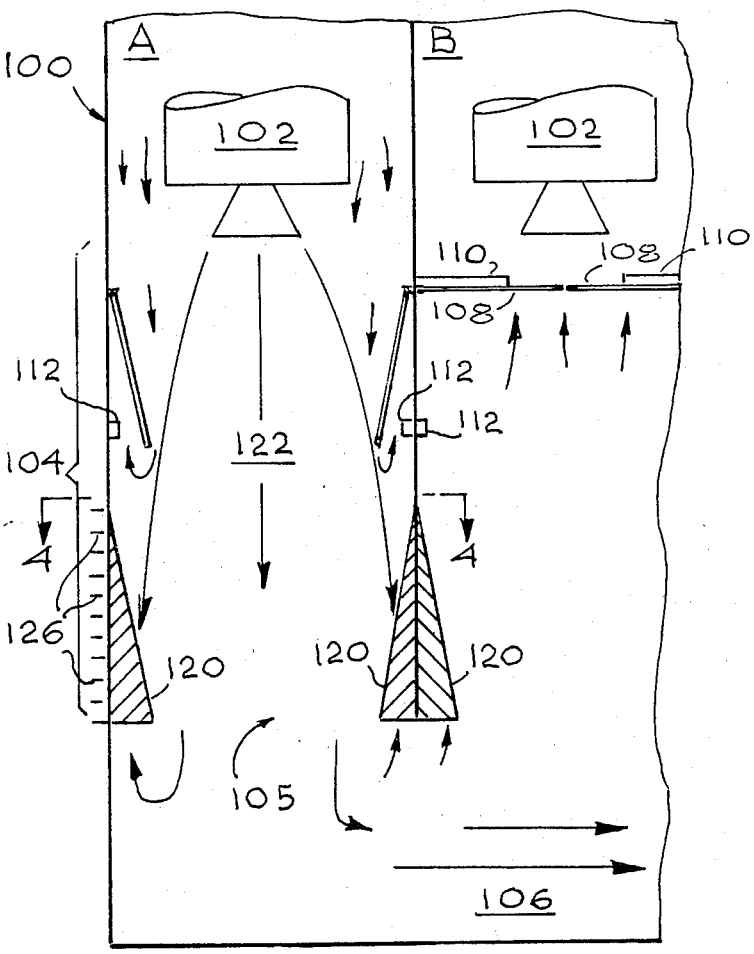
FIG. 3 is a schematic sectional view of a portion of the arrangment of FIG. 2.
Figure 4:
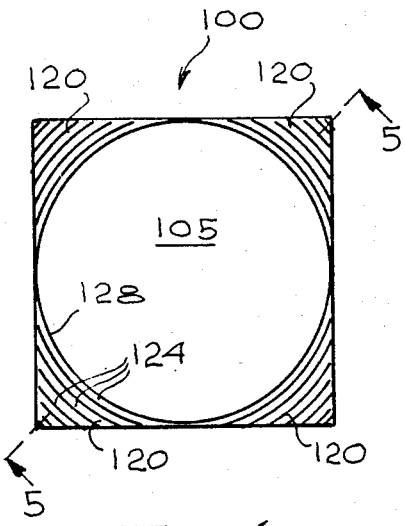
FIG. 4 represents a sectional schematic view taken along the line 4—4 of FIG. 3, looking downward.

As best shown in FIGS. 3 and 4, the transition section 104 is square in cross-section in the upper portion thereof where the doors 108 are mounted. The square cross-section extends downwardly to approximately the midpoint of the transition section in order to accommodate the movement of the doors between vertical and horizontal positions. Stop elements in the form of bars 110 mounted along the walls of the chamber, shown for the B chamber in FIG. 3, are provided to limit the upward travel of the doors 108. The doors are normally permitted to hang down in an almost vertical attitude alongside the walls of the chamber, separated therefrom by spacer members 112 which permit missile exhaust gases to enter the region behind the doors 108 and develop pressure forces which close the door for a chamber, such as B, which is not experiencing a missile firing and which permit the doors 108 to be drawn away from the walls of the transition section against the exhaust plume for a chamber, such as A, where a missile is being fired.

In the lower portion of the transition section 104, below the region where the doors 108 are operative, the cross-section of the chamber changes gradually from square to circular. This is effected by building up the corners of the chamber 100 with tapered fillets 120 which provide a circular opening at the outlet of the transition section 104 into the manifold 106. This is clearly shown in FIGS. 4 and 5 which show the opening 105 surrounded by the fillets 120 which fill the corner spaces in the square outline of the chamber 100.

The effect of the smooth transition section which gradually converts the cross-section of the exit region of the chamber 100 from square to circular is best illustrated in FIG. 3. The arrows in FIG. 3 indicate the direction of gas flow and the gas pressure force vectors. When a missile fires, as in the A chamber, a central exhaust plume 122 is formed. This draws entrained gases, principally air, from the upper end of the chamber along the sides of the missile 102 (indicated by the arrows shown outside the main exhaust plume 122). In the initial position of the missile 102, the exhaust 122 attaches to the transition wall surface well above the full circular area and forms a gas plug. This gas plug is maintained as the missile 102 flies out of the chamber 100. This exhaust gas plug is formed into a circular cross section by the filleted corners of the lower portion of the transition section 104. Since the exhaust is symmetrical about the central axis of the missile 102 and exhaust plume, transition from rectilinear to circular cross-section eliminates back flow in the bottom corners and maximizes the flow area into the plenum 106. The transition section 104 as depicted, by providing a smooth conversion from square to circular in a cross-sectional opening, allows a near maximum flow area for the rocket exhaust when the missile is flying out of the chamber 100 while at the same time allowing the formation of the gas plug while the rocket is firing in a restrained configuration and at initiation of launch. The length of the section containing the fillets 120 is sufficient to develop a smooth flow of the exhaust gases.

The contour of the fillets 120 is shown in the lower left-hand corner of FIG. 4 by a series of countour lines 124. These are taken at levels corresponding to the lines 126 of FIG. 3. The contour may be described as a smooth tapered concave surface beginning at the top of the fillet 120 and continuing to the bottom edge 128 which defines the opening 105. The contour lines 124 increase in radius of curvature with decreasing diameter of the open cross-section as one progresses from top to bottom of a fillet 120. All four fillets 120 are identical.

Figure 5:
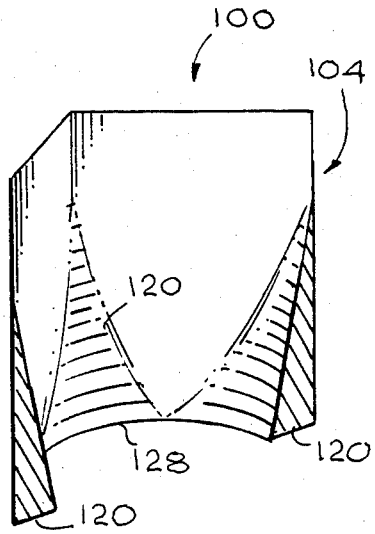
FIG. 5 is a perspective view, in section, taken along the line 5—5 of FIG. 4

In the preferred embodiment, the round bottom opening of the transition section 104 is smaller than the square cross-section of the storage chamber transition section in the upper region thereof. The ratio of the areas of the two cross-sections, bottom round opening/upper square opening, of the embodiment depicted in FIG. 5 is equal to $\pi/4$. This can readily be determined by assigning a unit length to one side of the square outline in FIG. 5, which equals the diameter D of the circle 128. The formula for the area of the circle 128 is $\pi(D/2)^2$ which, for a diameter of unit length, becomes $\pi/4$. Since the area of a square of unit length is one square unit, the ratio of the two areas equals $\pi/4$.

Figure 6:
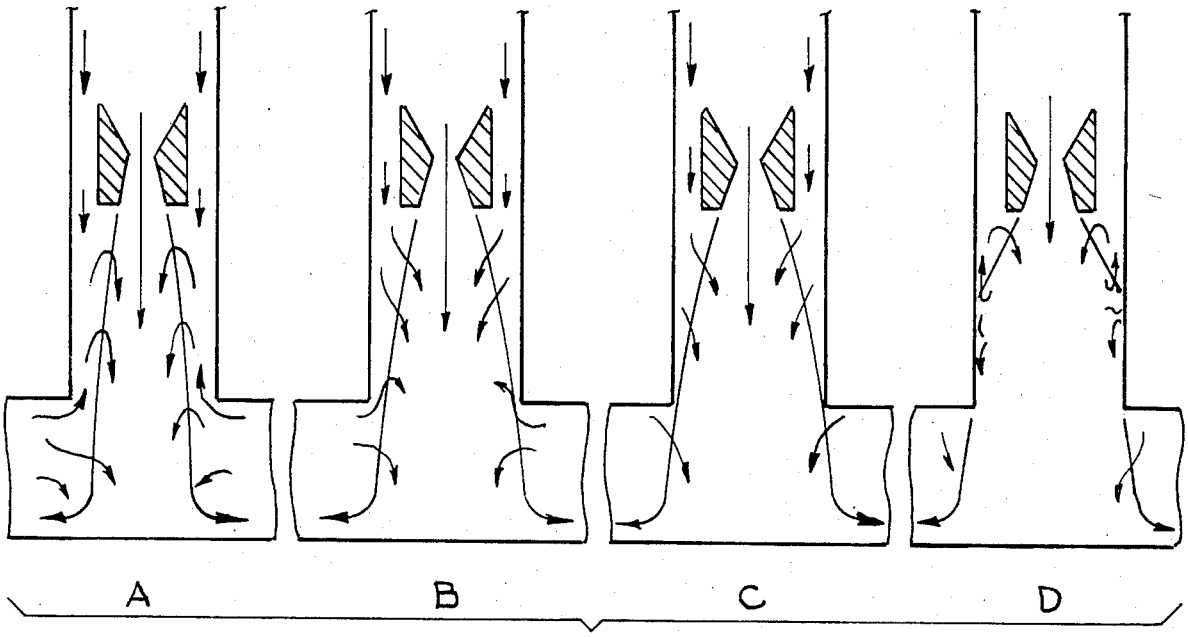
FIGS. 6A–6D are sketches illustrating different exhaust phases during a rocket firing.

The following is a general explanation for the flow of a rocket exhaust flowing through a general transition section. Depending on the section length and the exit circular diameter, the transition section pressure initially decreases, due to entrainment of the air into the exhaust as the exhaust flow expands with increasing rocket motor pressure during ignition. During the initial phase (A), as shown in FIG. 6A, the mixing region of the exhaust is entraining ambient air from the chamber holding the firing rocket, the transition section and plenum tube below the transition section.

With higher rocket motor pressure, the exhaust boundary expands and approaches the transition section circular diameter. The exhaust mixing region inside the transition section is starved of plenum air and the transition section (as well as the chamber holding the firing rocket) pressure begins to decrease more rapidly. This phase (B) is shown in FIG. 6B.

With still higher rocket motor pressure, the exhaust boundary diameter grows larger and the annulus bounded by the transition section circular diameter and the exhaust boundary becomes too small to provide plenum gas to the exhaust mixing region inside the transition section with the required amount of entrained air. This phase (C) is shown in FIG. 6C.

Phase C is an unstable condition since the mixing region inside the transition section still requires entrained air. "Attachment" occurs as the exhaust immediately expands, lowering the transition section pressure (as well as the pressure in the chamber holding the firing missile) by entraining what air is left inside the transition section. But the exhaust mixing region, being still starved for air, recirculates a sufficient part of itself until the mixing region entrainment is satisfied and an equilibrium condition is achieved with the attachment line well above the transition section exit. This phase (D) is shown in FIG. 6D.

Figure 7:
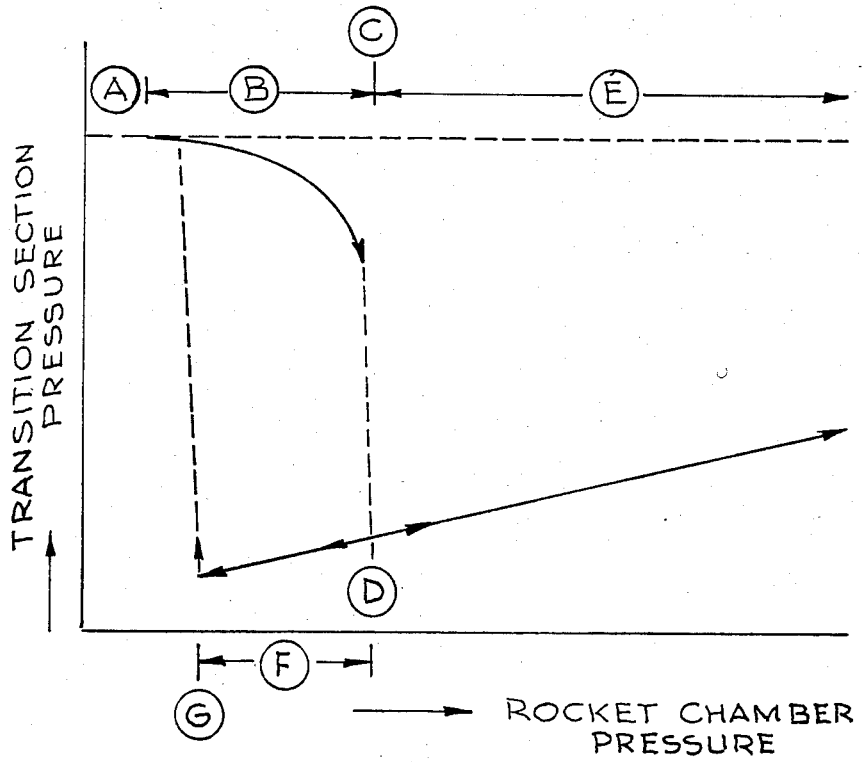
FIG. 7 is a plot of the phases of FIGS. 6A–6D.

Under this last condition of full "attachment", if the rocket motor pressure is raised still higher, the transition section pressure and attachment line will increase to a new equilibrium position (E); if the rocket motor pressure is lowered, the transition pressure and attachment line will decrease to a new equilibrium position (F). Finally, when the rocket chamber pressure is some two to three times lower than the rocket chamber pressure at full "attachment", the rocket exhaust will "detach" from the transition section surface suddenly and return to local ambient pressure (G) of the plenum tube. FIG. 7 is a pressure curve graph showing the various conditions of FIGS. 6A–6D as discussed above.

If the top end of the chamber holding the firing missile is closed to the outside, the pressure of the chamber will be the same as the transition section pressure; if the top of the chamber is open to the outside then, depending upon the flow area between the rocket and walls of the chamber, the pressure of the chamber will be higher than the transition section pressure.

It will be readily apparent from comparing FIGS. 6A–6D with FIGS. 2–5 showing the structural configuration of the present invention that the desired "attachment" of rocket exhaust to the transition section walls is more readily effected by arrangements in accordance with the present invention.

Although there have been described above specific arrangements of a gas management transition device in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. Apparatus for controlling the flow of exhaust gases of missiles in a plurality of missile storage chambers during firing of a missile comprising:

a plurality of missile storage chambers oriented generally adjacent one another, said chambers having a generally rectilinear cross-section over the major extent thereof;

a plenum chamber extending generally along the bottom of said storage chambers and coupled to each storage chamber for disposing of exhaust gases generated in said storage chambers by the firing of a missile therein; and a plurality of transition sections, one for each storage chamber, extending between respective chambers and the plenum chamber, each transition section including;

(a) a pair of doors pivotably mounted on a first pair of opposite sides of the transition section adjacent the juncture of the transition section with its associated chamber, said doors being pivotable between open and closed positions in response to gas pressure forces generated during the firing of a missile, said doors when in the closed position serving to close off the transverse bottom opening of the chamber; and (b) a plurality of tapered fillets formed in the corners of the rectilinear walls of the storage chamber smoothly changing the cross-sectional opening of the chamber from a rectilinear shape to a round opening.

2. The apparatus of claim 1 wherein said round opening is situated at the juncture between the transition section and the plenum chamber.

3. The apparatus of claim 1 wherein the fillets extend from a position near the edges of the doors, when the doors are in the open position, to the juncture of the storage chamber with the plenum chamber.

4. The apparatus of claim 1 including a plurality of stop elements positioned adjacent the closed position of the doors in order to limit the travel of the doors past a closed position in the upward direction.

5. The apparatus of claim 4 further including a plurality of spacing members mounted along opposite sides of the transition section in line with the doors and positioned to contact the ends of the doors when in the open position to maintain spaces between the doors and sides of the transition section.

6. The apparatus of claim 1 wherein each transition section comprises an upper region of generally square cross-section in which the doors are pivotably mounted at the upper end thereof for pivoting movement downward through the substantial extent of said upper region and a lower region wherein the corners of the transition section wall increase in radius of curvature with decreasing diameter of the opening in the direction of the bottom opening of the chamber.

7. The apparatus of claim 6 wherein said fillets are each formed with a rounded concave surface.

8. The apparatus of claim 7 wherein the cross-section of the lower region diminishes in area with increasing distance from the upper region.

9. The apparatus of claim 8 wherein the round bottom opening of the chamber is of reduced cross-sectional area relative to the square cross-section opening of the transition section in said upper region.

10. The apparatus of claim 9 wherein the ratio of the area of said round bottom opening to the area of said square cross-section opening is $\pi/4$.

* * * * *